US005433133A

United States Patent [19]

La France

[11] Patent Number: 5,433,133

[45] Date of Patent: Jul. 18, 1995

[54] QUICK DETACHABLE GUN BARREL COUPLING MEMBER

[76] Inventor: Timothy F. La France, 5231 Cushman Pl. #7, San Diego, Calif. 92110

[21] Appl. No.: 206,653

[22] Filed: Mar. 7, 1994

[51] Int. Cl.[6] ..... F41A 21/34

[52] U.S. Cl. ..... 89/14.2

[58] Field of Search ..... 42/75.02, 79, 90, 105; 89/14.05, 14.2, 14.3, 14.4, 14.5, 14.6; 181/223

[56] References Cited

U.S. PATENT DOCUMENTS

| | | | |
|---|---|---|---|
| 2,987,966 | 6/1961 | Meyer | 89/14.5 |
| 4,664,014 | 5/1987 | Hawley et al. | 89/14.2 |
| 4,893,426 | 1/1990 | Bixler | 89/14.05 |

FOREIGN PATENT DOCUMENTS

| | | | |
|---|---|---|---|
| 119861 | 4/1945 | Australia | 42/105 |

*Primary Examiner*—Stephen C. Bentley
*Attorney, Agent, or Firm*—Charles C. Logan, II

[57] ABSTRACT

A coupling member for quickly and easily attaching and detaching a firearm accessory to the front end of the gun barrel of a firearm. The front end of the coupling member has an internally threaded portion having a left hand thread. The rear end of the coupling member has a plurality of circumferentially spaced notches that form finger members between them. The finger members have radially inwardly extending lug members. The coupling member is slidably received on the front end of the gun barrel of a firearm and has at least three radially extending lug members and when rotated the respective lug members will engage each other. When a firearm accessory is threaded into the front end of the coupling member, it will form a secure, accurately aligned mechanical coupling which may be disassembled by reversing the process.

6 Claims, 2 Drawing Sheets

QUICK DETACHABLE GUN BARREL COUPLING MEMBER

BACKGROUND OF THE INVENTION

The invention relates to coupling devices and more specifically to a coupling member for quickly and easily attaching and detaching a firearm accessory to the front end of the gun barrel of a firearm that has at least three radially extending lug members adjacent its front end formed at predetermined spaced intervals from each other around its perimeter.

Presently there are lugged coupling apparatus on the market for attaching firearm accessories to the front end of the gunbarrel of a firearm that has radially extending lug members adjacent its front end, but these have not proven entirely satisfactory. One example of such a device is illustrated in the Bixler U.S. Pat. No. 4,893,426. Embodiments of this patent tested had right hand threads which proved to loosen during firing. Overtightening on installation was not 100% successful and made removal when hot impossible. Some examples of firearm accessories are flash hiders, silencers, grenade launchers, blank adapters and the like.

It is an object of the invention to provide a novel coupling member for attaching firearm accessories to the front end of the gun barrel that may be quickly and easily removed therefrom.

It is also an object of the invention to provide a novel coupling member for attaching a firearm accessory to the front end of a gun barrel that uses a left hand thread on both the firearm accessory and the internal threading at the front end of the coupling member that will cause the natural rotation of the gas from the right hand rifling of the gun barrel to tighten the firearm accessory to the coupling member as it is fired.

It is another object of the invention to provide a novel coupling member for attaching a firearm accessory to the front end of the gun barrel of a firearm that is economical to manufacture and market.

It is a further object of the invention to provide a novel coupling member for attaching a firearm accessory to the front end of the gun barrel of a firearm that utilizes mating external lugs on the outer surface of the gun barrel and mating internal lugs on the interior of the coupling member.

It is an additional object of the invention to provide a novel coupling member for attaching a firearm assembly to the front end of the gun barrel of a firearm which allows for changing the firearm accessory without completely removing the coupling member from the rear end of the accessory. Further, this invention requires less than two revolutions of the accessory from the coupling to effect complete removal.

Other objects of the invention will become apparent from time to time throughout the specification and claims as here and after related.

SUMMARY OF THE INVENTION

The novel coupling member has been designed for use with firearm accessories, one of which would be a flash hider for the Heckler and Koch MP5 submachine gun. The flash at night from the vortex flash hider is nearly undetectable. When properly installed the interface of the flash hider is seated against the muzzle of the barrel and secured in place.

The coupling member is in the form of a tubular sleeve having an internally threaded portion having a left hand thread adjacent its front end. The rear end of the tubular sleeve has three circumferentially spaced longitudinally extending notches. The laterally spaced notches form longitudinally extending fingers members between them. The finger members have radially inwardly extending lug members.

The coupling member is installed on the front end of the gun barrel of a firearm having three radially extending lug members adjacent its front end. This is done by aligning the lug members of the gun barrel with the slots of the coupling member and sliding the coupling member onto the front end of the gun barrel of the firearm. Next the coupling member is rotated counter clockwise to a position which allows the lug members to align with each other so that the two parts cannot be longitudinally pulled apart. A short pin extends radially inwardly through the wall of the tubular member so that its front end will act as a stop member to limit rotational motion of the coupling member with respect to the gun barrel when the tip of the pin engages the lateral surface of one of the lug members on the gun barrel. Next the firearm accessory, for purposes of this discussion a flash hider, has its rear end threadably screwed into the front end of the coupling member with a left hand thread until the internal shoulder in the flash hider seats against the muzzle of the gun barrel and hand tightening will draw the respective mating lug member together. The natural rotation of the gas from the right hand rifling of the gun barrel will automatically maintain the flash hider securely to the fire arm. The mechanical coupling may be disassembled by reversing the process.

DESCRIPTION OF THE PREFERRED EMBODIMENT

Figure 1:
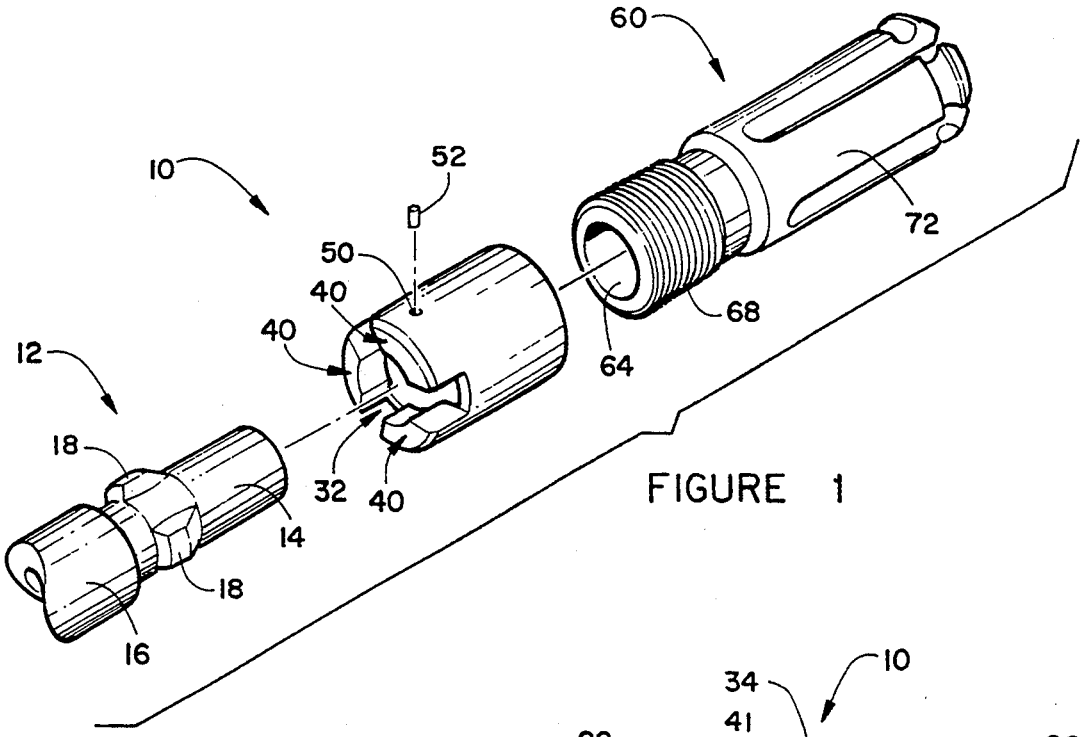
FIG. 1 is an exploded perspective view of the coupling member, the front end of the gun barrel of a firearm, and the firearm accessory.
Figure 5:
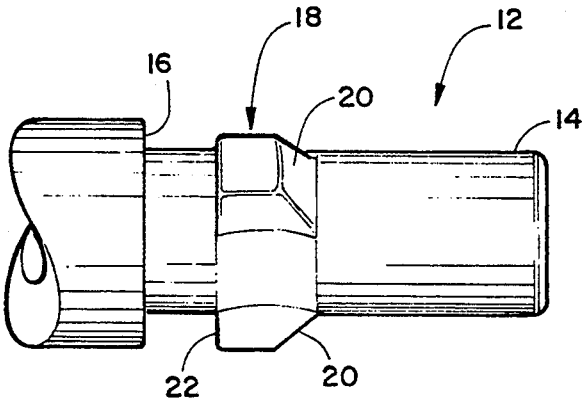
FIG. 5 is a side elevation view of the front end of the gun barrel.
Figure 6:
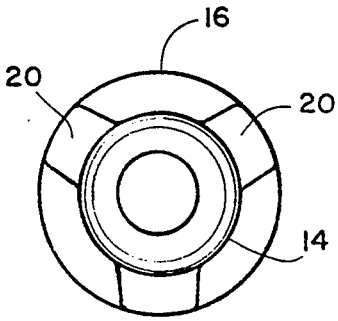
FIG. 6 is a front elevation view of the gun barrel.

The novel coupling member will now be described by referring to FIGS. 1–9 of the drawing. The coupling member is generally designated numeral 10. It is best seen in FIGS. 1, 5 and 6. Gun barrel shaft 12 has a reduced diameter portion 14 defining a circumferential raised shoulder 16. A series of circumferentially spaced external lugs 18 extend radially outwardly from the reduced diameter portion 14 a predetermined spaced distance from shoulder 16. The external lugs 18 have a tapered front surface 20 and a substantially 90 degree rear surface 22. External lugs 18 are configured to be slidably received in the rear end of coupling member 10 in the manner to be later described.

Figure 3:
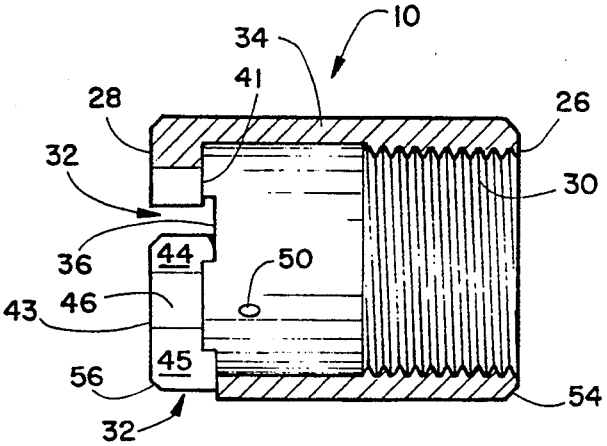
FIG. 3 is a cross sectional view taken along lines 3—3 of FIG. 2.
Figure 2:
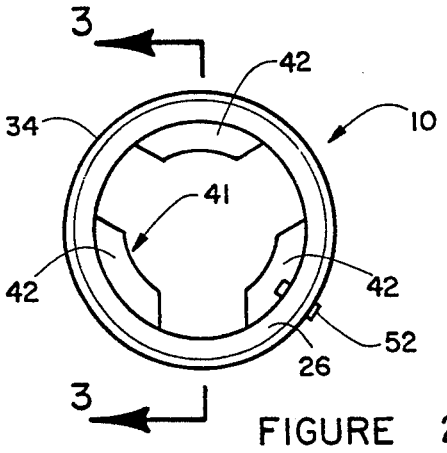
FIG. 2 is a front end elevation view of the coupling member.
Figure 4:
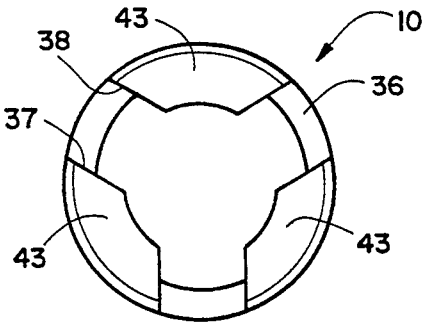
FIG. 4 is a rear end elevation view of the coupling member.
Figure 7:
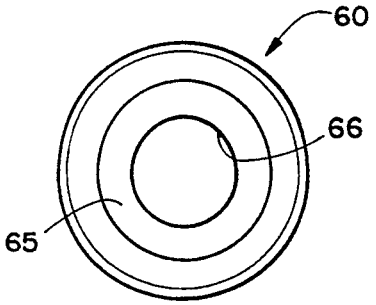
FIG. 7 is a rear elevation view of the flash hider.
Figure 8:
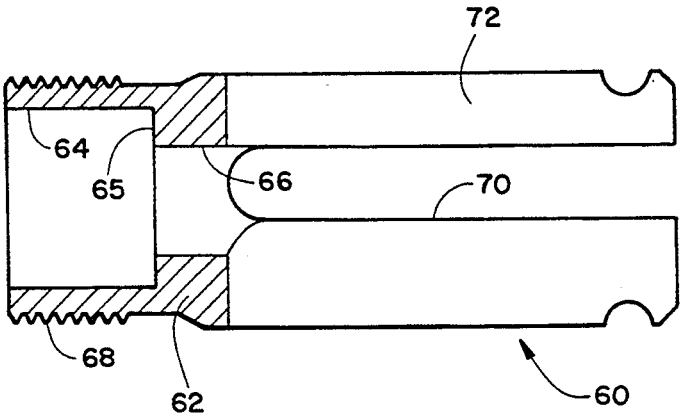
FIG. 8 is a cross sectional view taken along lines 8—8 of FIG. 9.
Figure 9:
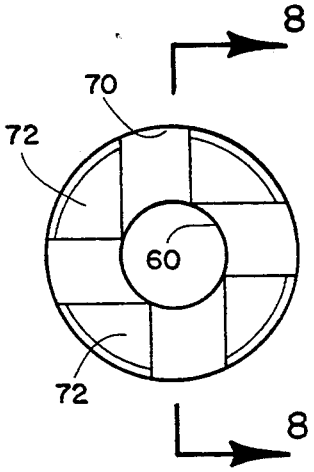
FIG. 9 is a front elevation view of the flash hider.

FIGS. 2,3 and 4 should be referred to for the forth coming description of coupling member, 10. It has a front end 26 and a rear end 28. Internally threaded portion 30 has a left hand thread. Three circumferentially spaced longitudinally extending notches 32 are formed in the rear end of tubular sleeve 34. These notches 32 each have a bottom wall 36 and laterally spaced side walls 37 and 38. The notches 32 form protruding finger members 40. A lug member 41 extends radially inwardly from the finger members 40 and they each have a top wall 42, a bottom wall 43, laterally spaced side walls 44 and 45, and an inner surface wall 46. A bore hole 50 is positioned slightly inwardly from one of the lug members 41. A short pin 52 is received therein and its front end extends past the inner surface of the tubular sleeve 34 and provides a stop member that limits rotation of the tubular coupling member on the end of gun barrel shaft 12. Tubular sleeve 34 has a chamfered outer surface 54 at its front end 26 and a chamfered surface 56 at its rear end 28.

Flash hider 60 is best described by referring to FIGS. 1,7,8, and 9. It has a tubular sleeve having a cylindrical recess 64 formed in its rear end. This recess forms a shoulder 65 that abuts the muzzle end of gun barrel shaft 12 when installed thereon. A bore 66 communicates with the front end of flash hider 60. The outer surface of the rear end of tubular sleeve 60 has external threads 68 having a left hand thread. The front end of flash hider 60 has longitudinally extending slots 70 that form forwardly extending fingers 72.

What is claimed is:

1. A coupling member for quick and easily attaching and detaching a firearm accessory to the front end of the gun barrel of a firearm that has at least three radially extending lug members adjacent its front end formed at predetermined spaced intervals from each other around its perimeter comprising:

a tubular sleeve having a front end, a rear end, an outer surface and an inner surface;

the inner surface of said tubular sleeve adjacent its front end having an internally threaded portion having a left hand thread;

the rear end of said tubular sleeve having at least three circumferentially spaced longitudinally extending notches, said notches each having a bottom wall and laterally spaced side walls;

said laterally spaced notches forming longitudinally extending finger members between them, said finger members having radially inwardly extending lug members each having a top wall, a bottom wall, laterally spaced side walls and an inner wall surface; and means for limiting rotational motion of said coupling member after it would be installed on the front end of the gun barrel of a firearm.

2. A coupling member as recited in claim 1 wherein the front end of said tubular sleeve has a chamfered outer surface.

3. A coupling member as recited in claim 1 wherein the rear end of said tubular sleeve has a chamfered surface.

4. A coupling member as recited in claim 1 further comprising a flash hider having a front end, a rear end, an outer surface and an inner surface; said flash hider being formed of a tubular sleeve having an externally threaded portion adjacent its rear end having a left hand thread, and the rear end of said flash hider is removably screwed into the front end of said coupling member.

5. A coupling member as recited in claim 4 wherein said flash hider further comprises a plurality of laterally spaced slots extending longitudinally from its front end that form a plurality of laterally spaced longitudinally extending leg members.

6. A coupling member as recited in claim 1 wherein said means for limiting rotational motion of said coupling member comprises a radially extending bore hole located adjacent the rear end of one of said finger members and a short pin is pressed therein with its front end extending a predetermined distance into the interior of said tubular sleeve to form a stop member for limiting rotation.

* * * * *